United States Patent [19]

Lenz

[11] 4,278,264

[45] Jul. 14, 1981

[54] SKATE

[76] Inventor: Brent L. Lenz, 610 S. Lake St., Long Prairie, Minn. 56347

[21] Appl. No.: 55,175

[22] Filed: Jul. 6, 1979

[51] Int. Cl.[3] ..... A63C 17/02

[52] U.S. Cl. ..... 280/11.28

[58] Field of Search ..... 280/11.28, 11.27, 11.3, 280/11.26, 11.19, 11.23, 11.1 R, 87.04 A

[56] References Cited

U.S. PATENT DOCUMENTS

| | | | |
|---|---|---|---|
| 967,742 | 8/1910 | Eckart | 280/11.26 |
| 2,330,338 | 9/1943 | Dekome et al. | 280/11.28 |
| 2,490,849 | 12/1949 | Wagner | 280/11.28 |
| 2,510,722 | 6/1950 | Snyder | 280/11.28 |
| 2,547,796 | 4/1951 | Swensson | 280/11.28 |
| 2,547,796 | 4/1951 | Swenson | 280/11.3 |
| 2,560,017 | 7/1951 | Ware | 280/11.28 |
| 2,578,911 | 12/1951 | VanHorn | 280/11.28 |
| 2,595,751 | 5/1952 | Balstad | 280/11.28 |
| 2,606,768 | 8/1952 | Wagner | 280/11.28 |
| 2,664,294 | 12/1953 | Kleinman | 280/11.27 |
| 2,739,819 | 3/1956 | Stoner | 280/11.28 |
| 2,744,759 | 5/1956 | Sternbergh | 280/11.28 |
| 2,826,422 | 3/1958 | Snyder | 280/11.2 |
| 2,899,209 | 8/1959 | Reynolds et al. | 280/11.28 |
| 3,693,988 | 9/1972 | Steinhiser | 280/11.26 |
| 3,738,673 | 6/1973 | Iseman | 280/11.28 |
| 4,103,917 | 8/1978 | Widolf | 280/11.28 |
| 4,132,424 | 1/1979 | Olivieri | 280/11.3 |
| 4,166,629 | 9/1979 | List | 280/11.28 |

FOREIGN PATENT DOCUMENTS

| | | | |
|---|---|---|---|
| 145838 | 6/1920 | United Kingdom | 280/11.23 |

*Primary Examiner*—David M. Mitchell

*Attorney, Agent, or Firm*—Burd, Bartz & Gutenkauf

[57] ABSTRACT

A roller skate having front and rear hangers connected together with main and secondary leaf spring jump bars. Locating and holding pins mount the secondary jump bar to the hangers. A truck carrying a pair of wheels is mounted on each hanger with resilient sleeves and a bolt. Each truck has an upright finger located in a pocket in a hanger. A resilient collar located in the pocket surrounds a part of the finger. The pocket has an undercut tapered side wall which is in engagement with the collar to allow the finger to have vertical and arcuate movement with respect to the upright axis of the finger.

25 Claims, 7 Drawing Figures

SKATE

SUMMARY OF THE INVENTION

The invention is directed to a skate having resilient means which provide for effective skate control. The skate has first and second plate means coupled together with jump bar means. The jump bar means comprise a pair of flexible bars located in a longitudinal upright plane. The bars flex in use to permit the plate means to have limited yieldable movement relative to each other. Locating pins connect opposite ends of one jump bar to the first and second plate means. A truck means is secured to each plate. Each truck means carries a pair of rotatable wheels adapted to rotatably support the skate on a skating surface. A first means, including yieldable means, secures the truck means a first portion of each plate. A second means, including a yieldable means, supports a second portion of each truck on each plate. The first means includes bolts and resilient sleeves surrounding the bolts. The bolts are connected to the plate means. The sleeves yieldably connect the bolts to the truck means. The second means includes upright fingers adapted to be located in pockets in the plate means. The fingers are surrounded by resilient collars located in the pockets. The pockets have an undercut cone shape which allows the fingers to angularly move in the pockets against the resilient sleeves and allows the fingers to longitudinally move in the pockets.

IN THE DRAWINGS

DESCRIPTION OF PREFERRED EMBODIMENT

Figure 1:
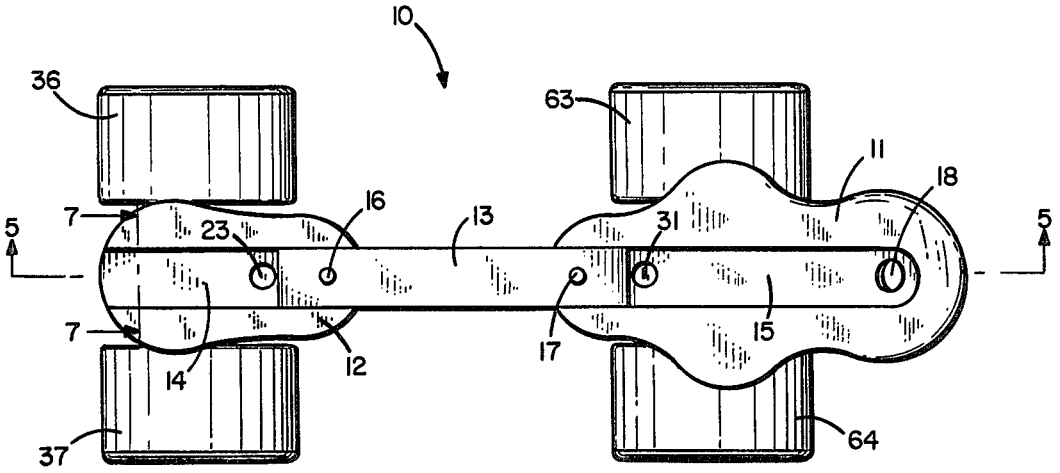
FIG. 1 is a top plan view of the roller skate of the invention.

Referring to FIGS. 1 to 4, there is shown a roller skate indicated generally at 10 adapted to be secured to the sole of a skate shoe by means of conventional fasteners, such as screws, rivets, or the like. Skate 10 can also be attached to a board, as a wood or plastic board, to complete a skate board. Skate 10 has a front plate or hanger 11 and a rear plate or hanger 12. A longitudinal main jump bar 13 is connected to plates 11 and 12 to locate plates 11 and 12 at a selected longitudinal distance apart to fit the sole of a shoe, or board, or the like. Jump bar 13 is an elongated generally flat stainless steel member or leaf spring. Other flexible material as plastics, can be used for jump bar 13. As shown in FIG. 1, the left end of jump bar 13 is located in a longitudinal groove 14 in the top of rear plate 12. A bolt 16 extends upward through plate 12 and is threaded into bar 13. The opposite or right end of jump bar 13 is located in a longitudinal groove 15 in the top of plate 11. An upwardly directed bolt 17 secures jump bar 13 to front plate 11.

Figure 5:
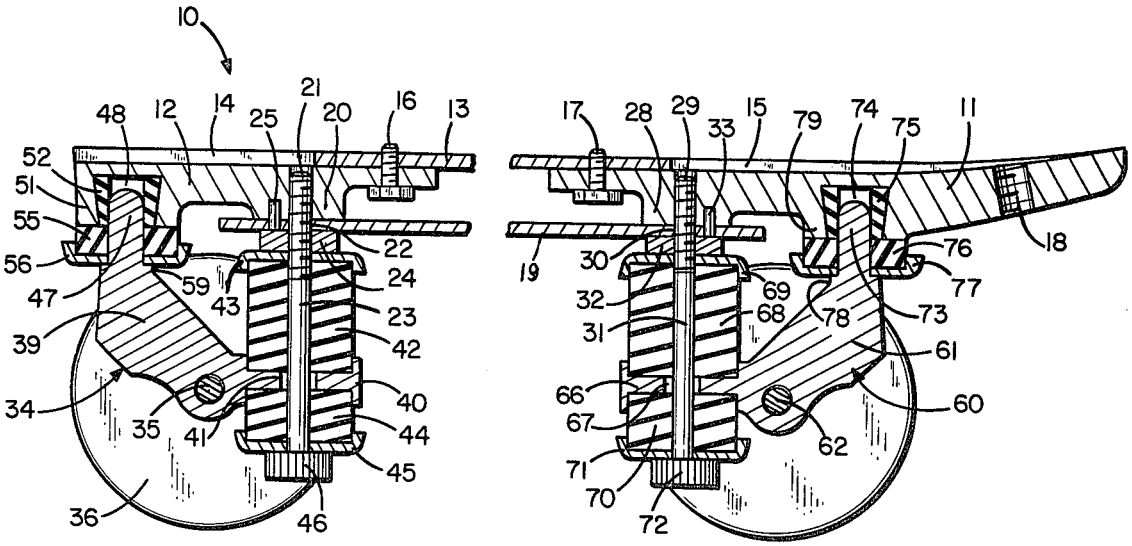
FIG. 5 is an enlarged foreshortened sectional view taken along the line 5—5 of FIG. 1.

As shown in FIGS. 1 and 5, the front section or nose of plate 11 projects upward and forwardly and has a threaded center hole 18. Hole 18 accommodates a threaded member or bolt of a floor engaging member or brake. An example of a floor engaging member is shown by Snyder in U.S. Pat. No. 2,826,422. Other types of floor engaging members can be attached to front plate A second jump bar 19 is located below primary jump bar 13. Bar 19 is an elongated linear flexible member, as steel, plastic and like yieldable means, that is located below and extends parallel to jump bar 13 in the longitudinal direction of skate 10. Jump bars 13 and 19 have selected lengths to longitudinally position front plate 11 and rear plate 12 relative to each other. The lengths of bars 13 and 19 can be changed to insure that plates 11 and 12 can be properly located and attached to the skate shoe or board.

Figure 6:
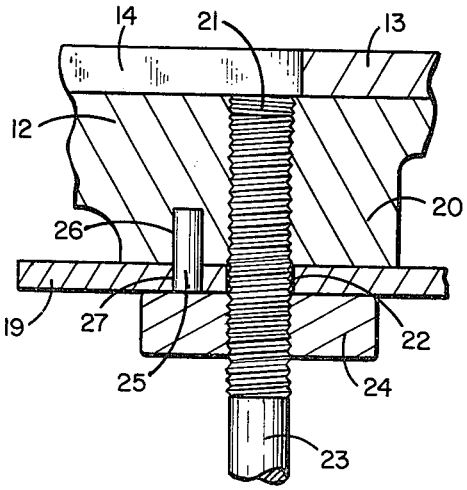
FIG. 6 is an enlarged sectional view of the auxiliary jump bar connection with the rear plate.

Jump bar 19, as shown in FIG. 5, has a left end located in engagement with the flat bottom of a first boss 20. Boss 20, is integral with and projects downwardly from rear plate 12. An upwardly directed threaded hole 21 extends through boss 20. Jump bar 19 has a hole 22 aligned with hole 21 to accommodate an upwardly directed bolt 23. The upper end of bolt 23 is threaded into threaded hole 21. A nut 24 is threaded onto bolt 23 and engages the bottom jump bar 19 to clamp the bar to first boss 20 and also lock bolt 23 in place when it is tightened. An alignment pin 25 fixes the position of jump bar 19 relative to boss 20. As shown in FIG. 6, pin 25 fits upwardly into a blind hole 26 in the bottom of boss 20 adjacent hole 21. Pin 25 projects downwardly from boss 20 and is located in a hole 27 in jump bar 19. Nut 24 is of a size to block the bottom of hole 27 to prevent pin 25 from working its way free of a boss 20 and jump bar 19. Pin 25 is a strong steel member that locates or aligns and holds jump bar 19 on boss 20 and helps take the longitudinal forces of jump bar 19 during use of skate 10. Pin 25 minimizes the bending and shearing forces of jump bar 19 on bolt 23.

Returning to FIG. 5, front plate 11 has a downwardly directed first boss 28 engageable with the forward end of secondary jump bar 19. Boss 28 has an upwardly directed threaded hole 29 aligned with a hole 30 in jump bar 19. An upwardly directed threaded bolt 31 extends through hole 30 and is turned into hole 29. A nut 32 threaded on bolt 31 clamps the forward end of jump bar 19 to the bottom of boss 28 and locks bolt 31 in place when it is tightened. An alignment pin 33 extends upwardly into boss 28 and a hole in jump bar 19. Nut 32 is of a size to cover the bottom of the hole to prevent pin 33 from separating from boss 28 and jump bar 19. Pin 33 is a steel member that functions the same as pin 25 shown in detail in FIG. 6. Pins 25 and 33 are locating and holding members for jump bar 19. When the skate 10 is mounted on a shoe, bolts 23 and 31 and trucks 34 and 60 are removed from plates 12 and 11. Pins 25 and 33 keep the holes in jump bar 19 aligned with the threaded holes 21 and 29 so that after the shoe is secured to plates 11 and 12 the bolts 23 and 31 can be threaded into holes 21 and 29.

Figure 2:
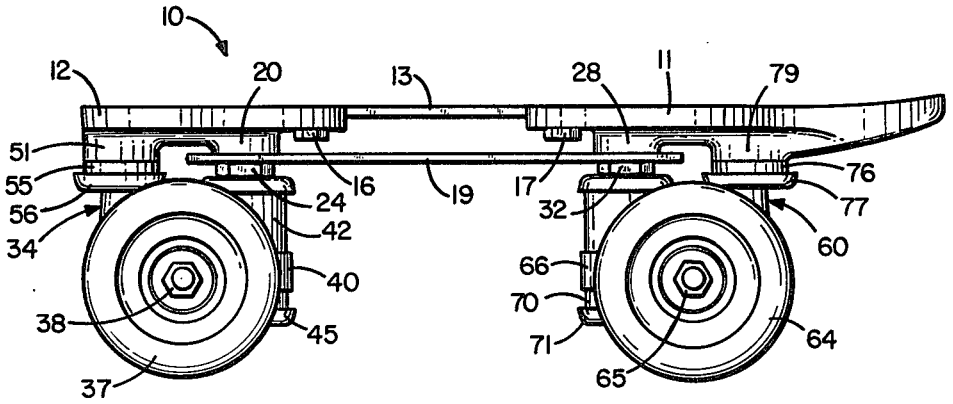
FIG. 2 is a side elevational view of FIG. 1.
Figure 4:
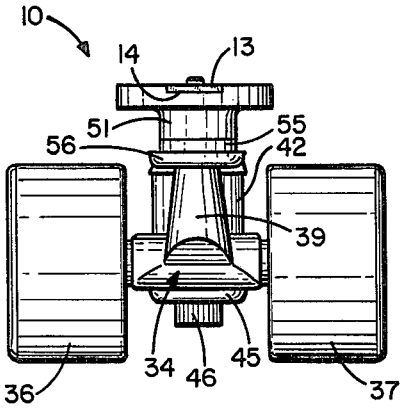
FIG. 4 is a rear elevational view of FIG. 1.

Referring to FIG. 5, a first truck indicated generally at 34 is located below rear plate 12. Truck 34 carries a transverse axle 35. Wheels 36 and 37 are rotatably mounted on opposite ends of axle 35. Conventional nuts, such as nut 38 shown in FIG. 2, are threaded on the ends of axle 35 to retain wheels 36 and 37 on axle 35. Wheels 36 and 37 are conventional cylindrical structures having an inner cylinderical member mounted on axle 35 and an outer sleeve rotatably mounted on the inner member with a roller bearing.

Truck 34 has a central body 39. A forwardly directed arm or platform 40 extends from the lower portion of body 39 in the general horizontal plane of axle 35. Arm 40 has an upright hole 41 accommodating bolt 23. Hole 41 is substantially larger than the diameter of the bolt 23, whereby truck 34 has a limited 360° movement around its upright axis. A first resilient sleeve 42 is interposed between the top of arm 40 and nut 24. A washer 43 is located between the upper end of sleeve 42 and nut 24. A second resilient sleeve 44 extends downwardly from arm 40 and engages a second washer 45. Bolt 23 has a head 46 engaging washer 45. Bolt 43 is threaded into boss 20 and applies a compression or clamping force on sleeves 42 and 44. Sleeves 42 and 44 are resilient rubber or plastic members that are concentrically located about bolt 23 as they have central holes for accommodating bolt 23.

Figure 7:
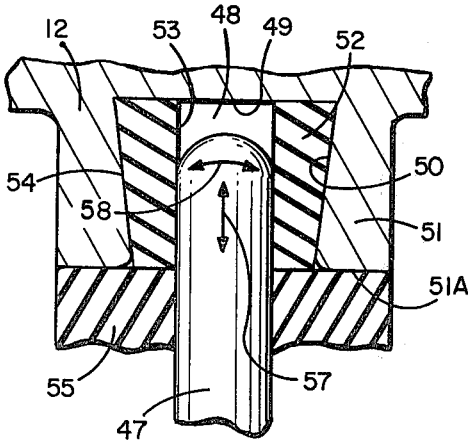
FIG. 7 is an enlarged sectional view taken along the line 7—7 of FIG. 1.

The upper part of body 39 has an upwardly directed cylindrical finger 47. Finger 47 extends generally parallel to bolt 23 with the upright plane of axle 35 located between finger 47 and bolt 23. The longitudinal upright axis of finger 47 is normal to or 90° from the horizontal plane of axle 35. The finger 47 terminates in a top semispherical end. Finger 47 projects upwardly into a pocket or hole 48 in a second boss 51 integral with plate 12. As shown in FIG. 7, pocket 48 has a generally flat wall 49 and downwardly converging cone-shaped inside wall 50. Wall 50 is undercut from the lower open end of pocket 48 toward top 49. The diameter of the lower open end of pocket 48 is about two-thirds of the diameter of wall 49. A resilient annular member or collar 52 is disposed in pocket 48. Collar 52 is a compressible rubber member having a central cylindrical hole 53 accommodating the upper end of finger 47. Collar 52 has a snug sliding fit around finger 47. Collar 52 has an outside cone-shaped surface 54 located in surface engagement with inside wall 50 of boss 51. For example, pocket 48 has a depth of 1.4 cm from the open end to the bottom wall 49. Wall 49 is circular and flat and has a diameter of 1.8 cm. The open end has a diameter of 1.4 cm. Side wall 54 has an inverted cone-shape and diverges from the open end at an angle of about 10° from the vertical axis of pocket 48.

A resilient sleeve 55 surrounds finger 47 immediately below boss 51. Sleeve 55 bears on the lower flat face 51A of boss 51. Face 51A has a large annular bearing surface which applies compression force to sleeve 55. The large face 51A minimizes damage to sleeve 55 which occurs with bosses having narrow faces. A washer 56 engages the bottom of sleeve 55 and a top shoulder 59 of truck body 39. Bolt 23 applies compression force on sleeve 55 and holds finger 47 in pocket 48.

As shown in FIG. 7, the upper end of finger 47 is normally located below wall 49. Finger 47 can yieldably move in a vertical direction, as shown by arrow 57, into and out of pocket 48. Finger 47 can also move in an arcuate or angular direction about a 360° arc about the vertical axis of pin 47, as indicated by arrow 58. The outer end of finger 47 can move against the side wall of resilient sleeve 52. Finger 47 will not contact inside wall 50, as sleeve 52 has a working thickness which increases toward wall 49.

Figure 3:
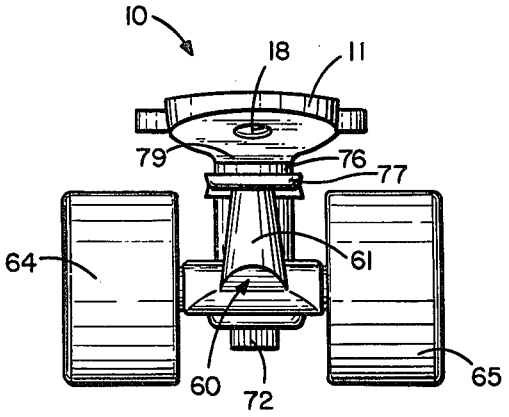
FIG. 3 is a front elevational view of FIG. 1.

Referring to FIGS. 2, 3 and 5, a second truck indicated generally at 60 is located below front plate 11. Second truck 60 has a body 61 carrying a transverse axle 62. Wheels 63 and 64 are rotatably mounted on opposite ends of axle 62. Conventional nuts, as nuts 65, shown in FIG. 2, releasably attach wheels 63 and 65 to axle 62. Wheels 63 and 64 are identical to wheels 36 and 37.

As shown in FIG. 5, a rearwardly directed arm or platform 66 extends from body 61 in the general horizontal plane of axle 62. Arm 66 has an upright hole 67 accommodating bolt 31. Hole 67 is a size substantially larger than the diameter of bolt 31 whereby truck 60 is free to move relative to bolt 31. An upper resilient sleeve 68 surrounding bolt 31 rests on top of arm 66. A washer 69 is interposed between the top of sleeve 68 and nut 32. A second resilient sleeve 70 extends downwardly from the bottom of arm 66 and rests on a washer 71. Bolt 31 has a head 72 that engages washer 71 whereby the bolt 31 compresses sleeves 68 and 70 and resiliently attaches truck 60 to plate 11.

The upper end of body 61 has an upright cylindrical finger 73. Finger 73 extends generally parallel to bolt 31. The upright plane of axle 62 is located between finger 73 and bolt 31. The longitudinal upright axis of finger 73 is normal to or 90° from the horizontal plane of axle 62. Finger 73 has an upper spherical end located in a pocket 74 formed in a downwardly directed second boss 79. Boss 79 is a cylindrical member integral with the bottom portion of plate 11. Pocket 74 has an undercut cone shape that has side walls that taper in an outward direction toward the bottom of the pocket. Pocket 74 has a shape identical to the shape of pocket 48, as shown in FIG. 7.

An annular resilient member or collar 75 is located in pocket 74. Collar 75 has a cylindrical hole accommodating the finger 73 and an annular tapered side wall engaging the side wall of pocket 74. Collar 75 increases in thickness toward the bottom of pocket 74. A resilient sleeve 76 surrounds finger 73 and engages a large bottom face of boss 79. Sleeve 76 also rests on a washer 77 carried on a shoulder 78 around the base of finger 73. Bolt 31 holds body 61 and finger 73 in an upright position with finger 73 located partially in the pocket 74. Finger 73 extends in a upright direction generally parallel to the upright direction of bolt 31.

Skate 10 is used with a shoe, board, or other foot supporting structure. Jump bars 13 and 19 can vary in length to accommodate a particular shoe or board. Jump bar 13 is removable from plates 11 and 12 by removing bolts 16 and 17. A bar of a selected length is bolted to plates 11 and 12. Jump bar 19 can be mounted on plates 11 and 12 by removing the bolts 23 and 31. Bar 19 is placed on pins 25 and 33 to align the bar with the holes for bolts 23 and 31. Bolts 23 and 31 also hold trucks 34 and 60 in a resilient floating assembled relation with plates 11 and 12. Bolts 23 and 31 are turned up into plates 11 and 12, respectively, to adjust the resilient action or compression forces applied to the resilient sleeves 42, 44, 55, 68, 70 and 76. Nuts 24 and 32 lock the bolts 23 and 31 in place after they are turned to a selected adjusted position.

In operation, the weight of the individual on plates 11 and 12 varies during the skating. The weight forces can vary in the longitudinal forward and reverse directions, as well as lateral directions. Fingers 47 and 73 move up and down in pockets 48 and 74 and move in arcuate directions against the side walls of resilient sleeves 52 and 75. This allows the skater to have control over the movement of trucks 34 and 60 during the skating.

The parallel jump bars 13 and 19 transmit forces to plates 11 and 12 from each truck 34 and 60. The yieldable or resilient characteristics of front and rear trucks 34 and 60 due to the yielding characteristics of the resilient sleeves 42, 44, 55 and 68, 70 and 76, and the reverse taper of bushings 52 and 75, permit the skater to have smooth control of skate 10.

While there has been shown and described the preferred embodiment of the skate of the invention, it is understood that changes in the materials, structures, size of structure, and arrangement of structures and parts, can be made by those skilled in the art without departing from the invention. The invention is defined by the following claims.

The embodiments of the invention in which an exclusive property or privilege is claimed are defined as follows:

1. A skate comprising: first plate having a first pocket, a second plate having a second pocket, each pocket having a bottom, an open end, and a generally cone-shaped side wall that converges from the bottom of the pocket toward the open end of the pocket, said first and second plates adapted to be connected to a foot supporting structure, jump bar means connected to the first and second plates, means attaching the jump bar means to said first and second plates, a first truck mounted on the first plate, a second truck mounted on the second plate, wheel means rotatably mounted on each of said first and second trucks for supporting the skate on a skating surface, said first truck having an upright first finger means having a vertical axis, said finger means having a first portion located in the pocket of the first plate, first resilient collar means located in said first pocket, said first collar means having a side wall engageable with the cone-shaped side wall of the first pocket and a central hole accommodating a first portion of said upright first finger means, first annular resilient means surrounding a second portion of said first finger means engageable with said first plate, means supporting the first annular resilient means on said first truck whereby the first collar means and the first annular resilient means yieldably retain the first finger means in an upright position, said second truck having upright second finger means having a vertical axis, said second finger means located in the pocket of the second plate, second resilient collar means located in said second pocket, said second collar means having a side wall engageable with the cone-shaped side wall of the second pocket and a central hole accommodating a first portion of said upright second finger means, second annular resilient means surrounding a second portion of the second finger means engageable with the second plate, and means supporting the second annular resilient means on said second plate whereby the second collar means and second annular resilient means yieldably retain the second finger means in an upright position, first means yieldably connecting the first truck on the first plate, said first means including an upright bolt extended generally parallel to said first finger means connected to said first plate, and second means yieldably connecting the second truck on the second plate, said second means including a second upright bolt extended generally parallel to the second finger means connected to the second plate.

2. The skate of claim 1 wherein: said jump bar means comprises a plurality of bars connected to the first and second plates, one of said bars having end portions located in engagement with the first and second plates, and pin means connecting said end portions to the first and second plates, said pin means being spaced from said first and second bolts and extended generally parallel thereto.

3. The skate of claim 2 wherein: said first plate has a boss having a surface engageable with one end portion of the one of said jump bars, said second plate having a boss engageable with the other end portion of the one of said one jump bars, said pin means including a pin for each boss, said pin extended through a hole in an adjacent end portion.

4. A skate comprising: a first plate having a pocket, a second plate having a pocket, said first and second plates adapted to be connected to a foot supporting structure, jump bar means connected to the first and second plates, said jump bar means comprising a plurality of bars connected to the first and second plates, one of said bars having end portions located in engagement with the first and second plates, pin means connecting said end portions to the first and second plates, said first plate having a boss having a surface engageable with one end portion of the one of said jump bars, said second plate having a boss engageable with the other end portion of the one of said one jump bars, said pin means including a pin for each boss, said pin extended through a hole in an adjacent end portion, means attaching the jump bar means to said first and second plates, a first truck mounted on the first plate, a second truck mounted on the second plate, wheel means rotatably mounted on each of said first and second trucks for supporting the skate on a skating surface, said first truck having an upright finger means located in the pocket of the first plate, said second truck having upright finger means located in the pocket of the second plate, first means yieldably mounting the first truck on the first plate, second means yieldably mounting the second truck on the second plate, said first and second means each including resilient collar means positioned within a pocket and located about a finger means whereby each finger means is yieldably located within a pocket, said first means yieldably mounting the first truck to the first plate includes an upright bolt connected to the first plate, and resilient means surrounding the bolt and connecting the bolt to the first truck, said bolt extending through a hole in said one end portion of the one of said jump bars.

5. The skate of claim 4 wherein: said first truck has a platform, said resilient means being engageable with said platform, said bolt extended through a hole in the platform to hold the resilient means in engagement with said platform.

6. The skate of claim 5 including: nut means threaded on said bolt and engageable with said resilient means, said nut means being a releasable locking device allowing the adjustment of said bolt to vary the static compression of the resilient means.

7. The skate of claim 4 wherein: said second means yieldably mounting the second truck to the second plate includes an upright second bolt connected to the second plate and second resilient means surrounding the second bolt and connecting the second bolt to the second truck, said second bolt extending through a hole in said other end portion of the one of said jump bars.

8. The skate of claim 7 wherein: said second truck has a second platform, said second resilient means being engageable with said second platform, said second bolt extended through a hole in the second platform to hold the second resilient means in engagement with said second platform.

9. The skate of claim 8 including: second nut means threaded on said second bolt and engageable with said second resilient means, said second nut means being a releasable locking device allowing the adjustment of said second bolt to vary the static compression of the second resilient means.

10. The skate of claim 4 including: resilient means surrounding a portion of each finger means and engageable with an adjacent plate.

11. The skate of claim 4 wherein: each pocket of the first plate and second plate has a generally cone-shaped side wall that converges from the bottom of the pocket toward the open end of the pocket, said resilient collar means positioned within a pocket having a side wall engageable with the cone-shaped side wall of the pocket.

12. The skate of claim 4 wherein: said first and second trucks each have a platform, said platform having a hole, said first and second means yieldably mounting the first and second trucks on the first and second plates, respectively, each bolt extended through a hole in a platform, said resilient means surrounding said bolt and engageable with opposite sides of the platform, each of said pockets having a downwardly converging side wall, said resilient collar means located in a pocket having a tapered outside wall in surface engagement with the converging side wall of said pocket and a central passage for accommodating a part of the finger means, and annular resilient means surrounding said finger means and engageable with a portion of the plate, said bolt holding said annular resilient means in engagement with the plates.

13. The skate of claim 12 wherein: said first and second plates each having a downwardly extended second boss, each second boss having a bottom annular surface engageable with the annular resilient means.

14. The skate of claim 12 wherein: each finger means is normal to the axis of rotation of the wheel means.

15. The skate of claim 4 wherein: said first truck has a platform having an upper side and a lower side, said resilient means surrounding the bolt and connecting the bolt to the first truck comprising a first resilient sleeve surrounding the bolt engageable with the upper side of the platform, and a second resilient sleeve surrounding the bolt engageable with the lower side of the platform, and nut means threaded on the bolt operable to vary the static compression of the first and second resilient sleeves.

16. A skate comprising: a first plate, a second plate, said first and second plates adapted to be connected to a foot supporting structure, jump bar means connected to the first and second plates, means attaching the jump bar means to said first and second plates, said jump bar means comprising a plurality of bars connected to the first and second plates, one of said bars having end portions located in engagement with the first and second plates, said means attaching the jump bar means to said first and second plates including bolt and nut means connecting said end portions to the first and second plates, pin means spaced from the bolt means located in aligned holes in said first and second plates and said end portions to align the one of said bars on the first and second plates and reduce bending and shearing forces of said one of said bars on said bolt means, a first truck mounted on the first plate, a second truck mounted on the second plate, wheel means rotatably mounted on each of said first and second trucks for supporting the skate on a skating surface, first means yieldably mounting the first truck on the first plate, second means yieldably mounting the second truck on the second plate.

17. The skate of claim 16 wherein: said first plate has a boss having a surface engageable with one end portion of the one of said jump bars, said second plate having a boss engageable with the other end portion of the one of said one jump bars, said pin means including a pin for each boss, said pin extended through a hole in an adjacent end portion.

18. The skate of claim 16 wherein: said first plate has a boss having a first surface, said second plate has a boss having a second surface, said jump bar means having end portions located in engagement with said first and second surfaces, said pin means being mounted in each boss and projected from said first and second surfaces, said jump bar means having holes to accommodate the pin means.

19. The skate of claim 18 wherein: said jump bar means comprises a first jump bar connected to the first and second plates, and a second jump bar, said second jump bar having end portions located in engagement with said first and second surfaces and having holes for accommodating the pin means.

20. A skate structure comprising: plate means having a pocket, said pocket having a bottom, an open end, and a generally cone-shaped side wall that converges from the bottom of the pocket toward the open end of the pocket, truck means mounted on said plate means, wheel means rotatably mounted on said truck means to support the skate structure on a skating surface, said truck means having an upright finger means having a vertical axis extended into the pocket, resilient collar means located in said pocket, said collar means having a side wall engageable with the cone-shaped side wall of the pocket and central hole accommodating a first portion of said upright finger means, annular resilient means surrounding a second portion of said finger means engageable with the plate means, and means supporting the annular resilient means on the truck means, whereby the collar means and annular resilient means yieldably retain the finger means in an upright position, and means yieldably mounting the truck means on the plate means including upright bolt means spaced from and extended parallel to the finger means connected to the plate means and resilient means connecting the bolt means to the truck means.

21. The skate structure of claim 20 wherein: said truck means has a platform, said resilient means connecting the bolt means to the truck means being engageable with said platform, said bolt extended through a hole in the platform to hold the resilient means connecting the bolt means to the truck means in engagement with said platform.

22. The skate structure of claim 21 wherein: said platform has opposite sides, said resilient means connecting the bolt means to the truck means having a first resilient sleeve engageable with one side of the platform and a second resilient sleeve engageable with the other side of the platform.

23. The skate structure of claim 21 including: nut means threaded on said bolt and engageable with said resilient means connecting the bolt means to the truck means, said nut means being a releasable locking device allowing the adjustment of said bolt to vary the static compression of the resilient means connecting the bolt means to the truck means.

24. The skate structure of claim 20 wherein: said truck means has a platform having an upper side and a lower side, said resilient means connecting the bolt means to the truck means comprising a first resilient sleeve surrounding the bolt means engageable with the upper side of the platform and a second resilient sleeve surrounding the bolt means engageable with the lower side of the platform, and nut means threaded on the bolt means operable to vary the static compression of the first and second resilient sleeves.

25. The skate structure of claim 20 wherein: said finger means extends normal to the axis of rotation of the wheel means.

* * * * *

UNITED STATES PATENT AND TRADEMARK OFFICE

CERTIFICATE OF CORRECTION

PATENT NO. : 4,278,264

DATED : July 14, 1981

INVENTOR(S) : Brent L. Lenz

It is certified that error appears in the above-identified patent and that said Letters Patent are hereby corrected as shown below:

Column 2, line 3, after "Plate", insert --11--.

Column 2, line 31, after "of" omit --a--.

Column 3, line 12, "43" should be --23--.

Column 4, line 64, after "during" omit --the--.

Signed and Sealed this

*Twenty-second* Day of *September 1981*

[SEAL]

*Attest:*

GERALD J. MOSSINGHOFF

*Attesting Officer*

*Commissioner of Patents and Trademarks*